US005694376A

United States Patent [19]

Sullivan

[11] Patent Number: 5,694,376

[45] Date of Patent: Dec. 2, 1997

[54] METHOD AND ENHANCED CLOCK FOR DISPLAYING TIME

[75] Inventor: Mark K. Sullivan, Joplin, Mo.

[73] Assignee: Niobrara Research and Development Corporation, Joplin, Mo.

[21] Appl. No.: 534,880

[22] Filed: Sep. 27, 1995

[51] Int. Cl.[6] ..... G04C 19/00; G04C 17/00

[52] U.S. Cl. ..... 368/82; 368/240

[58] Field of Search ..... 368/79, 80–82, 368/223, 239–242

[56] References Cited

U.S. PATENT DOCUMENTS

| | | | |
|---|---|---|---|
| 4,095,414 | 6/1978 | Reich | 368/240 |
| 4,130,987 | 12/1978 | Schickedanz | 368/282 |
| 4,209,974 | 7/1980 | Noble | 368/84 |
| 4,407,587 | 10/1983 | Fujita | 368/108 |
| 4,759,002 | 7/1988 | Cash | 368/223 |
| 5,199,009 | 3/1993 | Svast | 368/240 |
| 5,214,624 | 5/1993 | Siebrasse | 368/82 |
| 5,253,228 | 10/1993 | Truett | 368/82 |

FOREIGN PATENT DOCUMENTS

| | | | |
|---|---|---|---|
| 3731872 | 8/1988 | Germany | 368/79 |

*Primary Examiner*—Vit W. Miska

*Attorney, Agent, or Firm*—Senniger, Powers, Leavitt & Roedel

[57] ABSTRACT

A method and device for displaying time using a single segment member where the length and position of the segment member reflects the time. The device generally comprises a timer circuit to set and maintain hours and minutes of time, and a segment member control circuit which is responsive to the timer circuit and adjusts the length and position of the segment member to reflect the time maintained by the timer circuit.

23 Claims, 9 Drawing Sheets

VCC
IN
OUT
GND
VCC
VCC
OSC IN
OSC OUT
RESET
IRQ/VPP
PA0
PA1
PA2
PA3
PA4
PA5
PA6
PA7
PB0
PB1
PB2
PB3
PB4
PB5
VCC
SET HOUR
SET MINUTE

METHOD AND ENHANCED CLOCK FOR DISPLAYING TIME

BACKGROUND OF THE INVENTION

This invention relates to a method and apparatus for displaying time, and, in particular, a clock display including a segment member for indicating time of day.

Various methods and devices have been used throughout the ages for keeping time. The sundial was employed centuries ago for tracking time. In more recent times, mechanical and electro-mechanical clocks have been employed to tell time. These clocks have one hand for designating the hour and another hand for designating minutes. Typically, these clocks also include a third hand for tracking seconds. Coming current, digital clocks were developed which display numerals corresponding to the hour and minute of day, and in some instances, seconds.

In addition to the ability of clocks to accurately display time, the aesthetics of these devices are also very important to consumers. Clocks come in various shapes and sizes and are made from a wide range of materials in an effort to accommodate the wide range of settings for clocks. There are kitchen clocks, grandfather clocks for living rooms, and small alarm clocks for bedrooms. Some clocks are made of gold, some of plastic. Many clocks have round faces, but there are also clocks that are uniquely configured, focusing on the artistic appearance of the device.

OBJECTS AND SUMMARY OF THE INVENTION

It is therefore a primary object of this invention to provide a method and device for displaying time. More specifically, it is an object to use a single display segment to indicate both the hour and the minute of time.

A more particular objective of this invention is to provide a method and device wherein the positioning of the segment member on a standard clock face reflects the hour and the minute of time. Specifically, it is an object to position the segment member along the perimeter of the clock face such that the starting position of the segment reflects the hour and the length or ending position of the segment reflects the minute.

It is also an object to employ such a time keeping device and method which also provides a desirable appearance. A further object is to provide the appearance based on the use of a single segment to indicate the time.

Another object is to eliminate the need to use two hands on a standard clock to tell time.

An additional object is to provide a clock with an attractive alternative appearance to traditional clocks, while allowing time to be accurately and quickly determined. Further, an object is to provide an approach that tracks and displays time differently from traditional methods, which makes telling time fun, attracts attention, and is a conversation piece.

To accomplish these and related objects, a method and clock are disclosed for displaying time. The clock comprises a timer circuit for maintaining the hour and the minute of time and a segment member which has an adjustable length for displaying time. A segment member control circuit is coupled between the timer circuit and segment member. The control circuit adjusts the length and position of the segment to display the time maintained by the timer circuit.

The method of telling time disclosed herein comprises the steps of illuminating a starting point on a clock face to indicate the hour and illuminating an endpoint defining a segment for indicating the minute.

BRIEF DESCRIPTION OF THE DRAWINGS

The accompanying drawings form a part of the specification and are to be read in conjunction therewith and in which like reference numerals are used to indicate like parts in the various views.

DETAILED DESCRIPTION OF PREFERRED EMBODIMENTS

The invention uses a single segment member to directly or indirectly reflect the time of day. Preferably, the segment member is positioned arcuately along the perimeter of a standard clock face.

Figure 1:
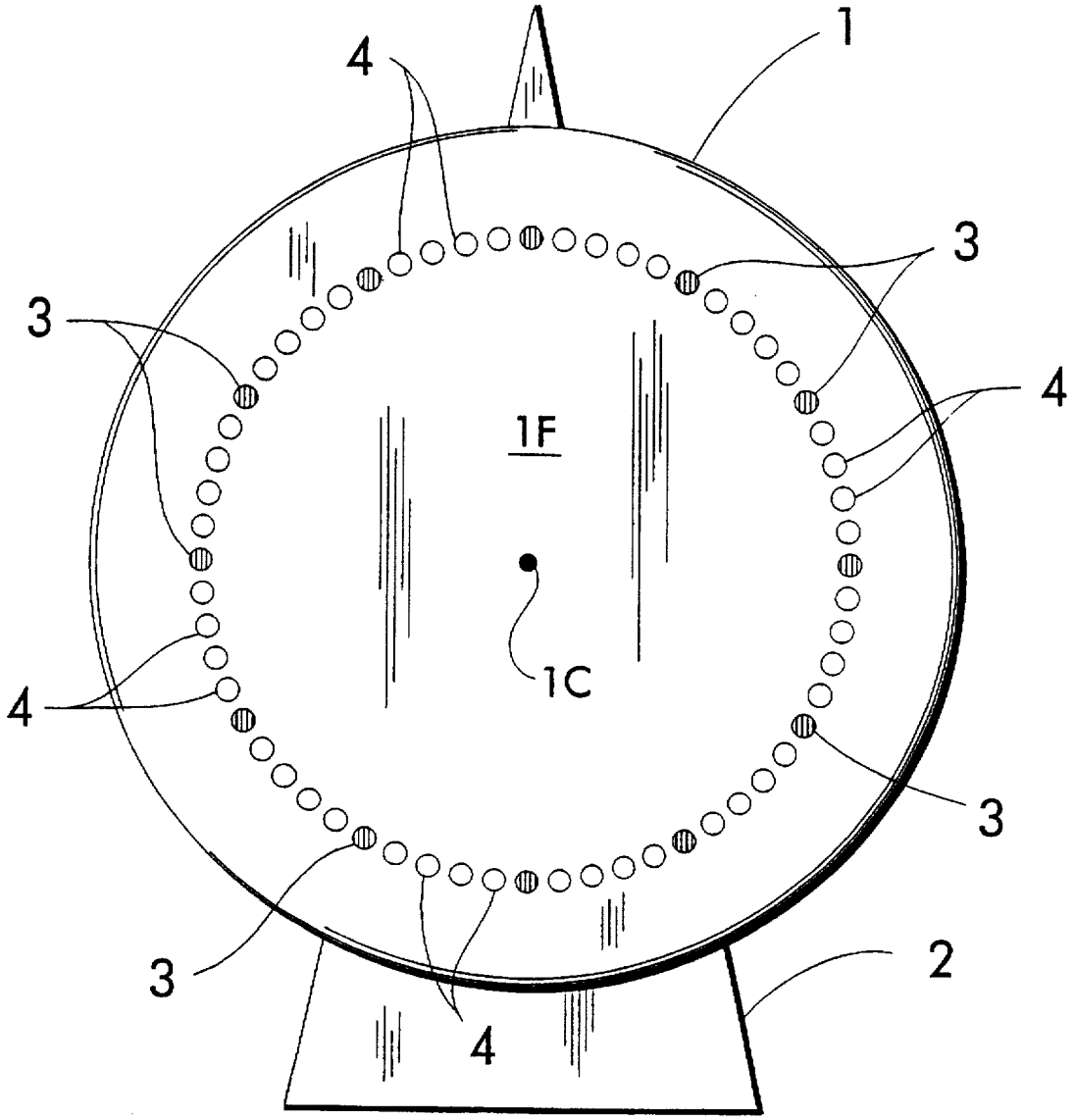
FIG. 1 illustrates a front plan view of a clock display according to one preferred embodiment of the present invention.

One preferred embodiment of a clock according to the present invention is shown in FIG. 1. The clock comprises a circular, substantially flat housing 1 which could be supported by a display base 2 or hung on a wall by suitable means. The clock face 1F has a plurality of hour lamps 3 and a plurality of minute lamps 4 arranged in a circular (or elliptical) pattern about a central point 1C. The lamps 3 and 4, preferably LEDs, are secured to the housing 1 by known means.

Preferably there are twelve hour lamps 3, each having a position corresponding to one of the twelve hours of day and located on the clock face 1F at positions corresponding to hours on a standard analog clock face. Likewise, there are preferably forty-eight minute lamps 4, each having a position corresponding to one of the four minutes between adjacent hour lamps. For smaller clock faces, the number of minute lamps may be reduced. To distinguish between hours and minutes, it is desirable to use one color lamp for hours and another color for minutes; alternatively, a larger lamp could be used for the hour than for minutes, or vise verse.

Circuitry is employed (discussed below) to create a segment member with lamps 3 and 4. FIGS. 2(A)–(E) show various times of day to illustrate the method of telling time according to the present invention. The left-most illustration of each of these figures shows a standard analog clock face indicating the time of day in the traditional manner using two hands (shorter hand indicating the hour and the longer hand indicating the minute). Above the arrow immediately to the right of the standard analog clock face illustration, the standard digital clock display for this time of day is shown. The center illustration of each figure, showing the clock face of a preferred embodiment of the present invention illustrated in FIGS. 1 and 3 using LEDs to comprise the segment member, displays the same time reflected by the left-most illustration of the standard analog clock. The right-most illustration of each figure, showing the clock face of another preferred embodiment of the present invention illustrated in FIGS. 4 and 5 using a continuous segment member (discussed later), displays the same time reflected by the left-most illustration of the standard analog clock.

It is contemplated by this invention that the segment member could be shown by a segment of illuminated light or sequence of illuminated LEDs, or inversely, by the unilluminated segment of light or sequence of unenergized LEDs.

The display of the preferred embodiment using LEDs to display the segment member will now be discussed as shown in the center illustrations of FIGS. 2(A)–(E).

As stated above, it is contemplated by this invention that the LEDs corresponding to hour positions (shown as LEDs 3 in FIG. 1) can be a different color than LEDs corresponding to minute positions (shown as LEDs 4 in FIG. 1) to facilitate accurate and quick reading of the clock.

Figure 2A:
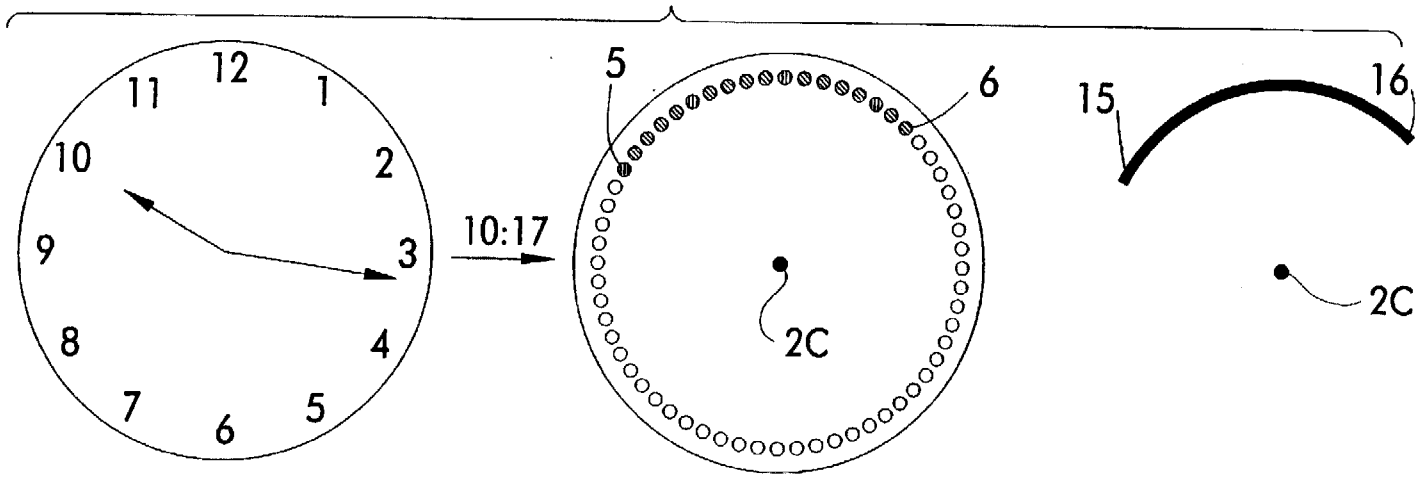
FIG. 2(A)–(E) show examples of the clock displays for two preferred embodiments for various times of the day.

In FIG. 2(A), the displays represent the time of 10:17 (a.m. or p.m.). Segment member 5–6 is depicted by shaded LEDs which may be illuminated or which may be unenergized with the unshaded LEDs being illuminated. The hour of ten is indicated by segment member 5–6 having a starting position 5 denoted by the first shaded LED which is the counter-clockwise most position of the segment member 5–6 with reference to a central point 2C on the clock face and is located at the position corresponding to the hour of ten o'clock on a standard analog clock face. The length of segment member 5–6 corresponds to seventeen minutes, and is depicted by the shaded seventeen LEDs which follow LED 5 in a clockwise direction with the last LED of the segment member at position 6. Thus, segment member 5–6 represents seventeen minutes past the starting position 5 which indicates the hour of ten.

An alternative display and method of telling time using a segment member 5–6 is to correlate hours to the starting position 5 of segment member 5–6 which is the counter-clockwise most endpoint with reference to a central point 2C on the clock face and to correlate minutes to the clockwise most end point 6 of the segment member 5–6 where position 5 corresponds to the position of the hour of ten o'clock on a standard analog clock face and position 6 corresponds to the seven minute position on a standard analog clock face, and thus, the time displayed is 10:07.

Figure 2B:
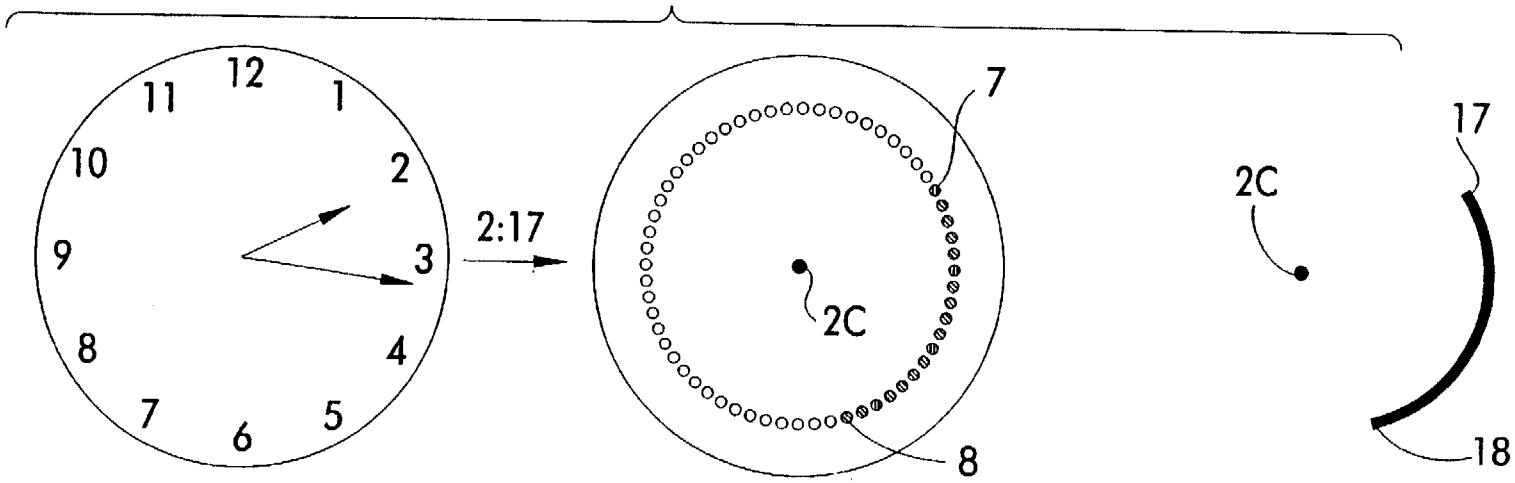

In FIG. 2(B), the displays represent the time of 2:17 (a.m. or p.m.). Segment member 7–8 is depicted by shaded LEDs. The hour of two is indicated by segment member 7–8 having a starting position 7 denoted by the first shaded LED which is the counter-clockwise most position of the segment member 7–8 with reference to a central point 2C on the clock face and is located at the position corresponding to the hour of two o'clock on a standard analog clock face. The length of segment member 7–8 corresponds to seventeen minutes, and is depicted by the shaded seventeen LEDs which follow LED 7 in a clockwise direction with the last LED of the segment member at position 8. Thus, segment member 7–8 represents seventeen minutes past the starting position 7 which indicates the hour of two. In contrast to FIG. 2(A), segment member 7–8 in FIG. 2(B) has a different starting position 7 corresponding to the different hour of two, while the length of segment member 7–8 is the same length as segment member 5–6 in FIG. 2(A) which represents the minute of seventeen past the current hour.

Figure 2C:
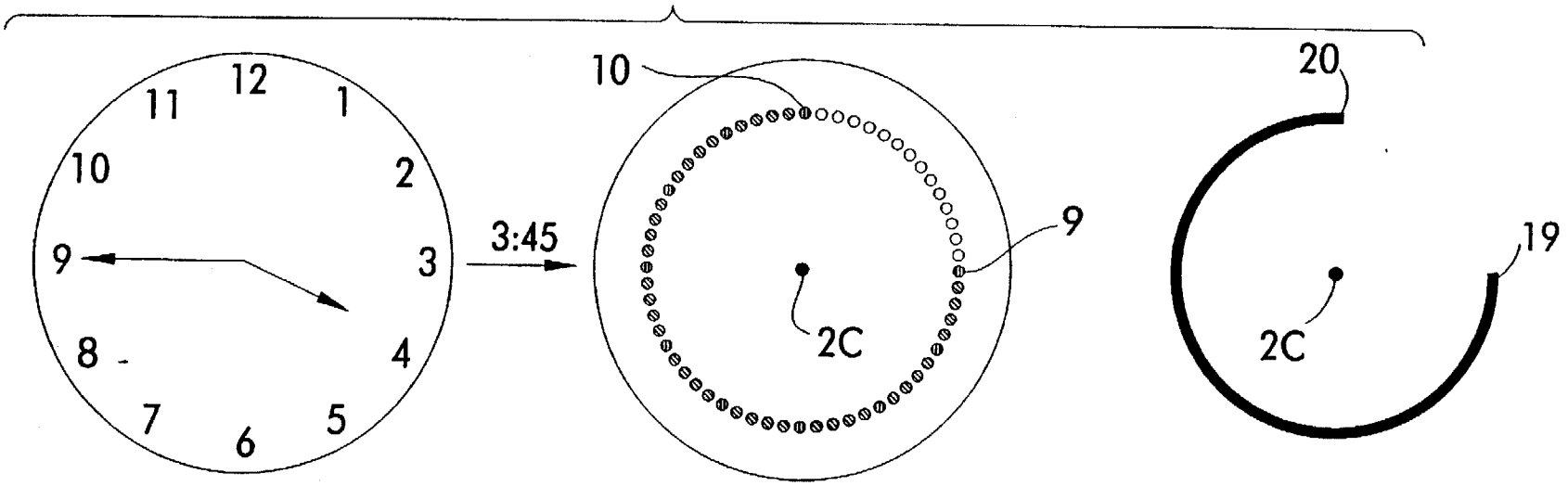

In FIG. 2(C), the displays represent the time of 3:45 (a.m. or p.m.). Segment member 9–10 is depicted by shaded LEDs. The hour of three is indicated by segment member 9–10 having a starting position 9 denoted by the first shaded LED which is the counter-clockwise most position of the segment member 9–10 with reference to a central point 2C on the clock face and is located at the position corresponding to the hour of three o'clock on a standard analog clock face. The length of segment member 9–10 corresponds to forty-five minutes, and is depicted by the shaded forty-five LEDs which follow LED 9 in a clockwise direction with the last LED of the segment member at position 10. Thus, segment member 9–10 represents forty-five minutes past the starting position 9 which indicates the hour of three (i.e., three-fourths a complete circle representing three-quarters past the hour of three).

Figure 2D:
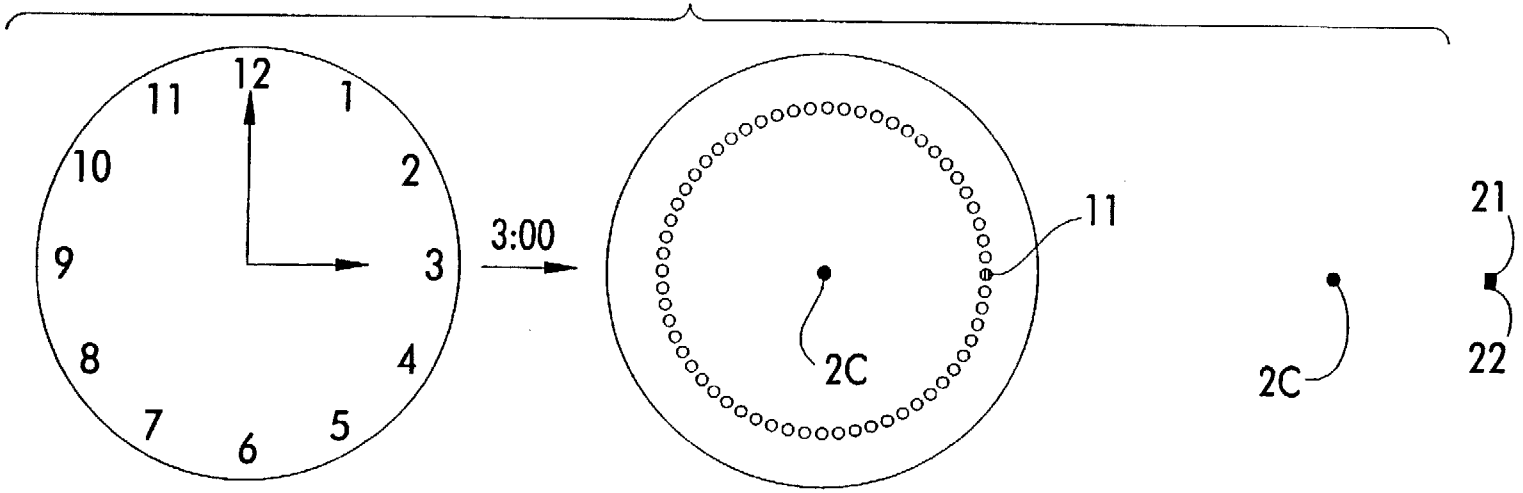

In FIG. 2(D), the displays represent the time of 3:00 (a.m. or p.m.). Segment member 11 is depicted by a single shaded LED. The position of segment member 11 in this preferred embodiment is at the position corresponding to the hour of three o'clock on a standard analog clock face. Since there are zero minutes past the hour, the length of the segment member is a single LED (LED 11).

Figure 2E:
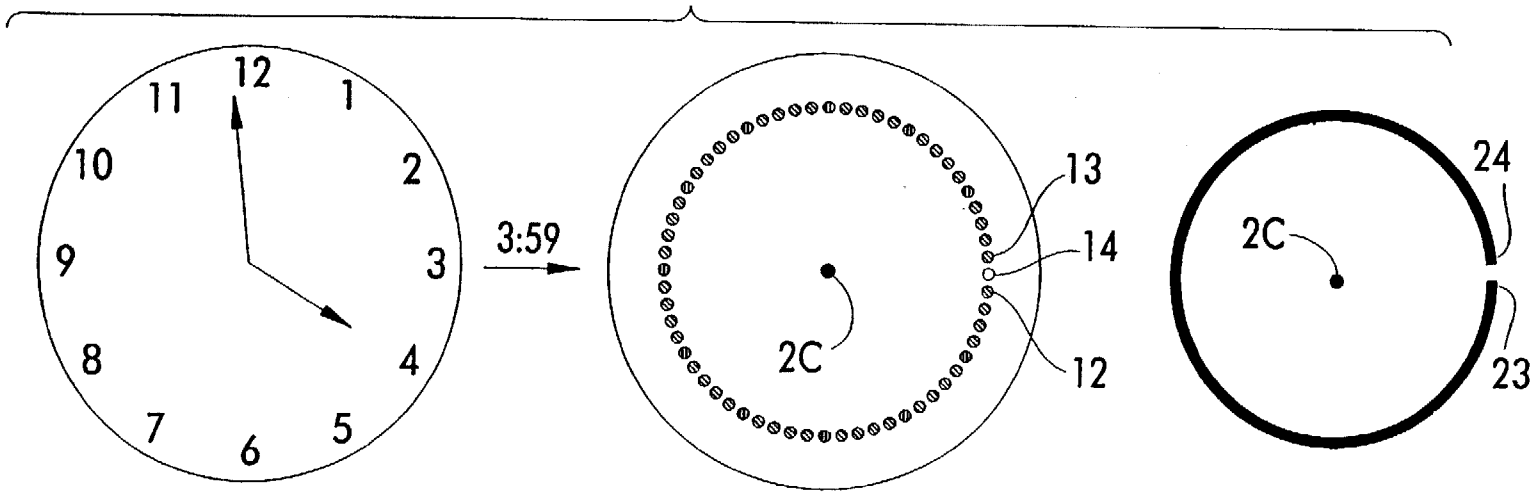

In FIG. 2(E), the displays represent the time of 3:59 (a.m. or p.m.). Due to the fact that this preferred embodiment uses sixty discrete LEDs to display the segment member, if the segment member was represented at the minute of fifty-nine past the hour by one hour position LED plus fifty-nine minute position LEDs, all sixty LEDs on clock face 1F would be illuminated to indicate the segment member. This would be true for all hours of the day, and thus, the clock display would provide no visual indication of the hour of the time of day. Therefore, when there are fifty-nine minutes past the hour, the beginning position of the segment member is the adjacent LED in a clockwise direction after the LED in the position corresponding to the current hour on a standard analog clock face. The segment member then comprises the adjacent LEDs in a clockwise direction from the starting position to the ending position of the segment member which is located at the LED adjacent to and before the LED in the position corresponding to the current hour on a standard analog clock face. As shown in FIG. 2(E), segment member 12–13 indicates the time of 3:59. LED 14 is located at the position corresponding to the hour of three o'clock on a standard analog clock face. LED 12 is adjacent to LED 14 and is located by traveling in a clockwise direction from LED 14. LED 13 is adjacent to LED 14 and is located by traveling in a counter-clockwise direction from LED 14. Since there are fifty-nine minutes past the hour, the location of the beginning of the segment member 12–13 is at LED 12 and continues for fifty-nine LEDs, ending at LED 13. The hour of three is indicated by the unshaded LED 14. It should be noted that the display of 3:59 shown in FIG. 2(E) is the inverse of the display of 3:00 shown in FIG. 2(D).

Figure 3:
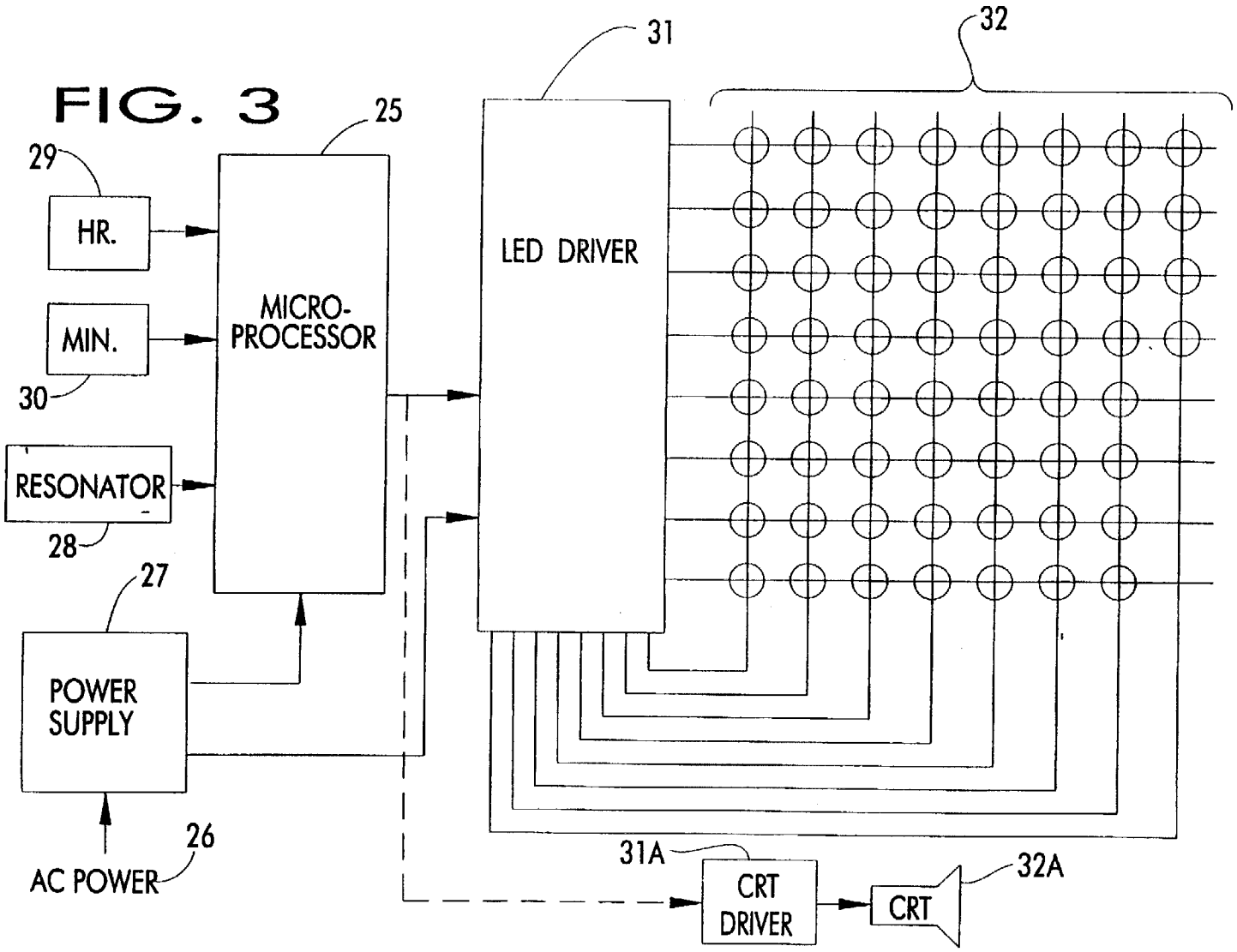
FIG. 3 is a circuit for selectively illuminating LEDs to generate a display according to the preferred embodiment of the present invention shown in FIG. 1, as well as another preferred embodiment where the clock face is a CRT and the timer circuit and segment member control circuits are a computer.
Figure 3A:
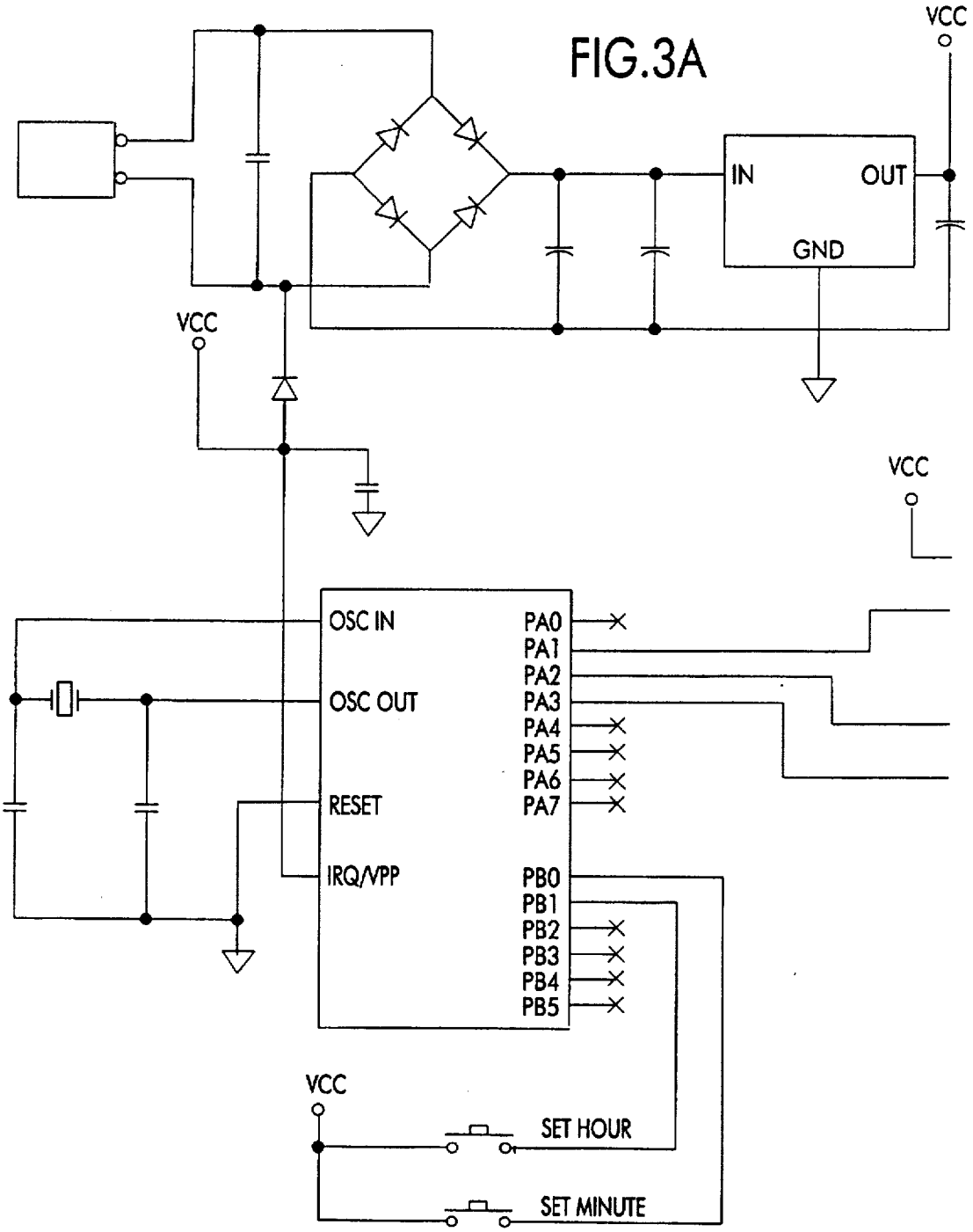
FIGS. 3A–B are a schematic circuit diagram for the control circuit for the clocks, with the outgoing lines of FIG. 3A being connected to the incoming lines of FIG. 3B.
Figure 3B:
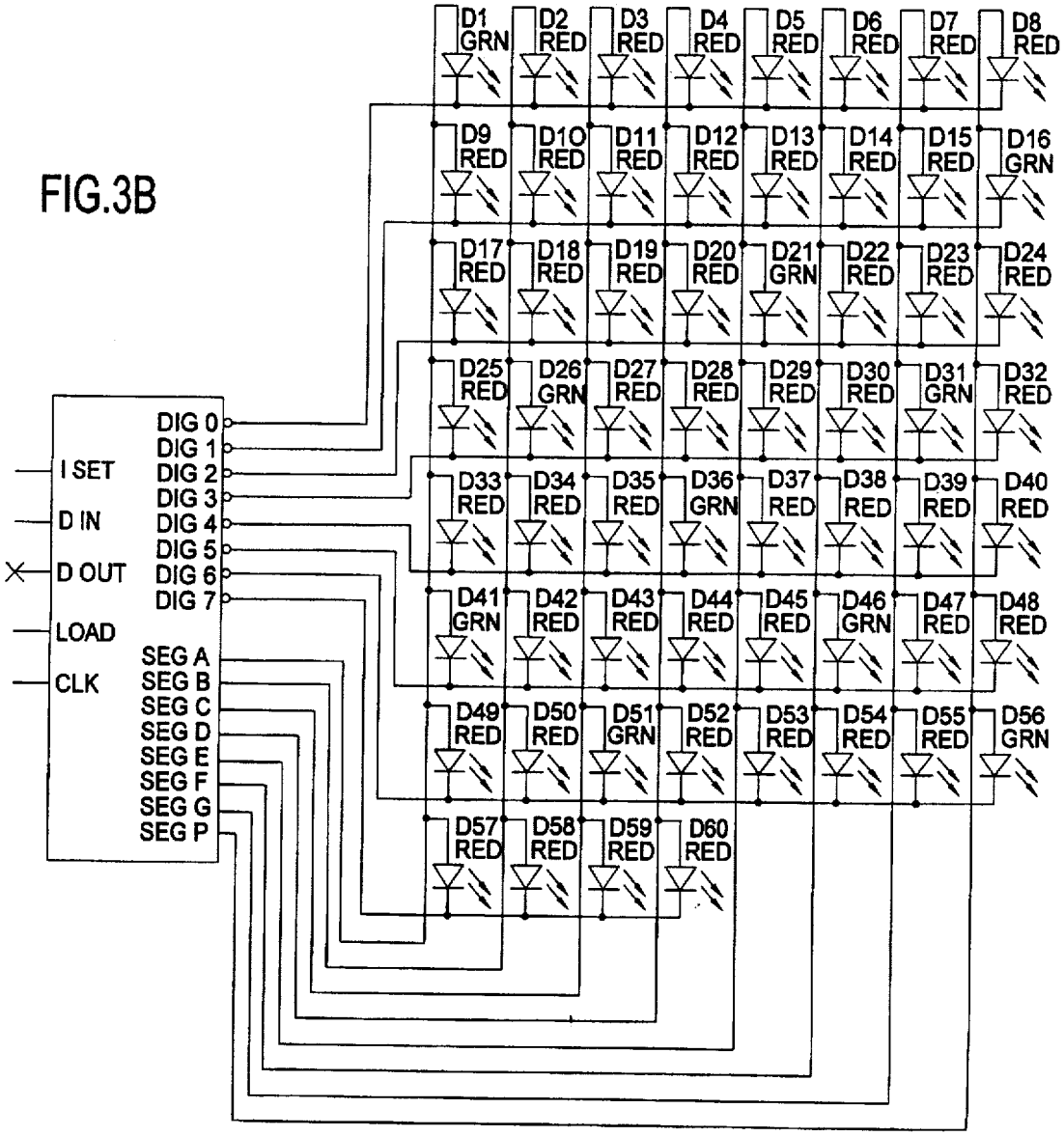

Referring now to FIG. 3, the circuit block diagram of this preferred embodiment is shown. FIGS. 3A–B show the schematic circuit diagram, with the outgoing lines of FIG. 3A being connected to the incoming lines of FIG. 3B. The segment member control circuit and timer circuit preferably comprise a microprocessor 25. While any microprocessor would be sufficient for this purpose, the Motorola 68HC05 was chosen for its low cost, low power requirement, and ease of interfacing to the power line as a frequency reference. Other choices include the Microchip Technology PIC6C54, the Zilog Z86E03 and the Motorola 68HC05. The PIC16C54's low power requirements allow it to maintain the time of day from a small battery.

In one preferred embodiment, microprocessor 25 maintains the time of day by counting impulses from a frequency reference. The frequency reference may be the AC power line 26 or the microprocessor's clock resonator 28. The AC power line 26 may be more accurate over the long term. Using the microprocessor's clock resonator makes it possible to keep time in absence of AC power but imposes a need for accuracy on the clock resonator. Where line power is supplied, an inexpensive ceramic resonator 28 can be employed for the microprocessor clock and the AC line 26 used for a frequency reference. Where the AC line is used as the frequency reference for time-keeping, even an r/c (resistor/capacitor) oscillator may be used for the microprocessor clock.

Power supply 27 provides power to microprocessor 25 and the LED driver circuit 31. The power supply preferably a wall-mounted transformer with an integral AC line connection plug and rectifier, filter, and regulator components in the clock itself as is common industry practice.

Time setting means are provided in the form of momentary contact switches (an hour switch 29 and a minute switch 30) that cause the hour and minute, respectively, to advance rapidly as long as the contact is held active by the user. In the preferred embodiment, microprocessor 25 monitors momentary contact switches 29 and 30, and advances the hour or minute at an accelerated rate while the respective contact is closed.

Microprocessor 25 continually determines the set of lamps to be illuminated and communicates these settings to the lamp driving chip 31. There are sixty LEDs shown in the array of LEDs 32 which are the twelve hour LEDs 3 and the forty-eight minute LEDs 4 as shown in FIG. 1. In order to conserve current and also to reduce the number of electronic parts required, the preferred embodiment drives the lamps in a multiplexed array of LEDs 32 of eight rows by eight columns (four positions of the array are unused) in which at most eight lamps are illuminated simultaneously, but the LEDs that are illuminated to indicate the segment member are flashed in quick enough succession that the human eye perceives a continuous illumination. One of the reasons for using solid state light emitting diodes is their self rectifying action which simplifies the construction of such a multiplexed driving scheme. Other reasons are their long life and low power requirement in contrast to incandescent filament lamps for example.

The LED driver circuit 31 of the preferred embodiment is the MAX7219 integrated circuit from Maxxim Integrated Products. This device is specifically intended to drive a multiplexed array of 64 LED lamps although its designers expected this to be in the form of eight, seven-segment display digits. Sixteen discrete transistors and associated resistors or any of a variety of other integrated circuits would also have been suitable.

In an alternative preferred embodiment, the clock uses an electronic measuring means like the preferred embodiment previously described to measure the time of day, but the display means is different.

Figure 4:
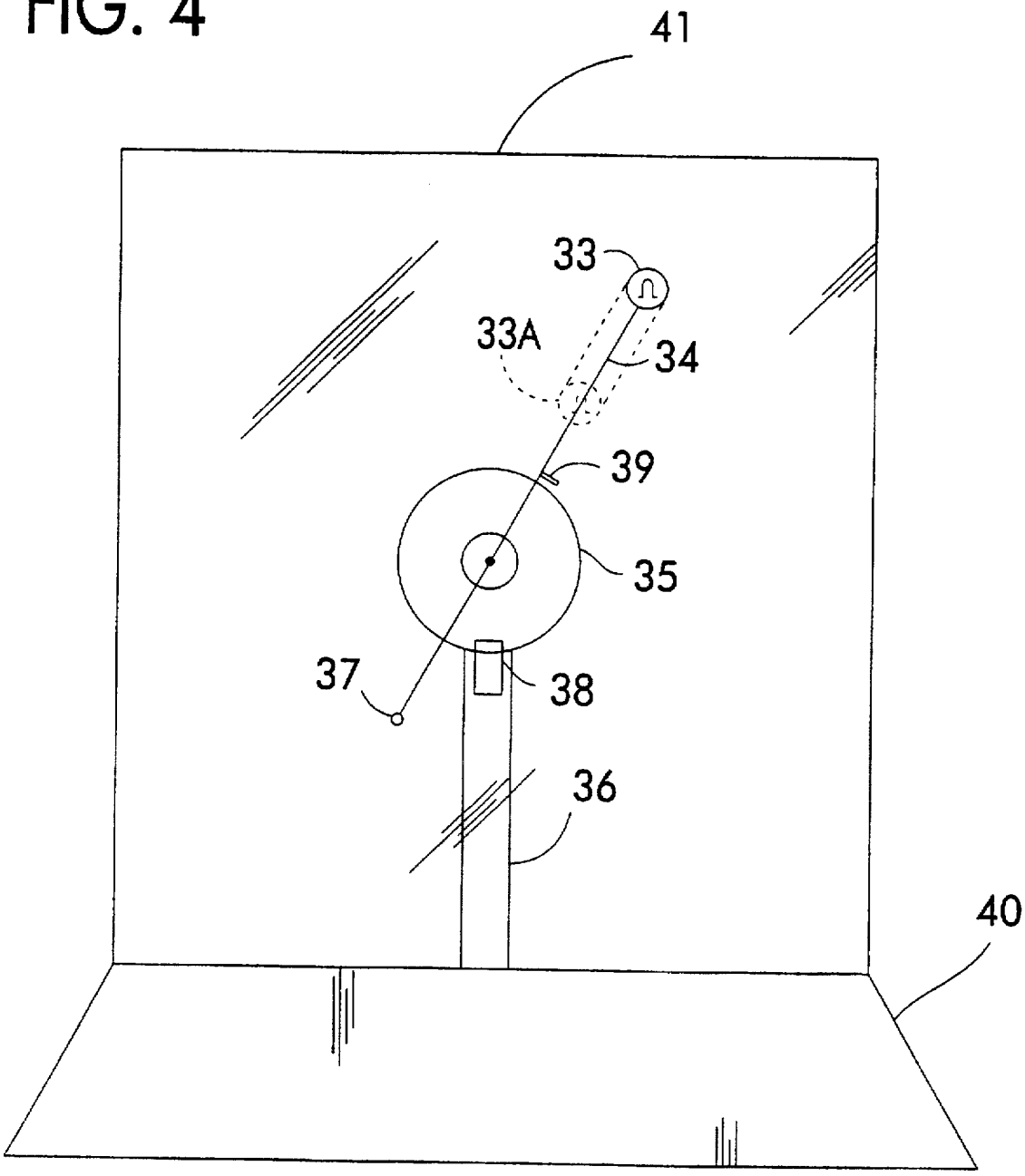
FIG. 4 illustrates a schematic front view of another preferred embodiment of a clock of the invention.

Referring to FIG. 4, the means for displaying the segment member is a single lamp 33 on the end of an arm 34 rotated in a vertical plane about a central point by motor 35. Motor 35 is mounted high enough above a trapezoidal (or rectangular) base 40 by a rectangular support 36 such that motor 35 rotates arm 34 freely and continuously about the central point and the path taken by lamp 33 forms a vertical circle of which the segment member is a portion. The circle enclosed by the path of lamp 33 comprises the clock face of this preferred embodiment. The segment member used to indicated the time of day is created by rapidly switching on and off lamp 33 once per revolution as it is whirled about a central point on the clock face by motor 35. It is contemplated by this invention that the segment member could be the illuminated segment of light, or inversely, the unilluminated portion of the arc of the rotating lamp 33. An opto-interrupter 38 is attached to the stationary housing of motor 35, and a thin metal flag 39 is attached to rotating arm 34 such that once per revolution of arm 34, flag 39 passes over the small gap in opto-interrupter 38 which provides a control signal indicating the position of the arm. The control signal synchronizes the switching on and off of lamp 33 based on the position of rotating arm 34 (thus the position of lamp 33) so that the segment member appears to be stationary over successive revolutions, and is used to monitor the speed of motor 35. Additionally, arm 34 is rotated at a high, substantially constant angular speed so that arm 34 itself is not visible and the segment member appears suspended in air. A counterweight 37 is mounted to arm 34 on the end opposite lamp 33 such that the point about which the arm is rotated is located between lamp 33 and counterweight 37 in order to minimize vibration of the system from the high speed whirling of lamp 33 and arm 34.

The components comprising the display of this preferred embodiment are preferably enclosed inside a hollow rectangular glass housing 41 attached by known means to base 40 which permits unrestricted viewing of the whirling lamp but prevents accidental contact with the invisible spinning arm. Enclosure 41 also serves to attenuate the noise generated by the spinning of rotating arm 34 and lamp 33. The housing may be filled with argon gas in lieu of air which reduces moisture inside the housing at lower ambient temperatures, attenuates noise, conducts heat to cool electrical components such as the motor.

Because the display device provides a continuous segment member, rather than discrete elements composing the segment member (as provided by the circular array of sixty LEDs in the first preferred embodiment as shown in FIG. 1), the length of the segment member for the hour position and for each minute corresponds to $1/61$ of 360 degrees. In this manner, when there are 0 minutes past the hour, the segment member comprises $1/61$ of 360 degrees (1 hour position+0 minute positions) of the circular path of the whirling lamp 33; and when there are 59 minutes past the hour, the segment member comprises $60/61$ of 360 degrees (1 hour position+59 minute positions) of the circular path of the whirling lamp 33.

Examples of the display of this preferred embodiment are shown in the right-most illustration of FIGS. 2(A)–(E).

In FIG. 2(A), the displays represent the time of 10:17 (a.m. or p.m.). Segment member 15–16 is depicted by arc 15–16 which could be the portion of the circular path traveled by lamp 33 when lamp 33 is illuminate, or inversely, the portion when lamp 33 is unenergized. The hour of ten is indicated by the segment member 15–16 having a starting position 15 which is the counter-clockwise most position of the segment member 15–16 with reference to a central point 2C on the clock face and is located at the position corresponding to the hour of ten o'clock on a standard analog clock face. The length of segment member 15–16 corresponds to seventeen minutes, and is depicted by the arc 15–16 ending at position 16. Thus, segment member 15–16 represents seventeen minutes past the starting position 15 which indicates the hour of ten.

An alternative display and method of telling time using a segment member 15–16 is to correlate hours to the starting position 15 of segment member 15–16 which is the counter-clockwise most endpoint with reference to a central point 2C on the clock face and to correlate minutes to the clockwise most end point 16 of the segment member 15–16 where position 15 corresponds to the position of the hour of ten o'clock on a standard analog clock face and position 16 corresponds to the seven minute position on a standard analog clock face, and thus, the time displayed is 10:07.

In FIG. 2(B), the displays represent the time of 2:17 (a.m. or p.m.). Segment member 17–18 is depicted by arc 17–18. The hour of two is indicated by segment member 17–18 having a starting position 17 which is the counter-clockwise most position of the segment member 17–18 with reference to a central point 2C on the clock face and is located at the position corresponding to the hour of two o'clock on a standard analog clock face. The length of segment member 17–18 corresponds to seventeen minutes, and is depicted by arc 17–18 ending at position 18. Thus, segment member 17–18 represents seventeen minutes past the starting position 17 which indicates the hour of two. In contrast to FIG. 2(A), the segment member 17–18 in FIG. 2(B) has a different starting position 17 corresponding to the different hour of two, while the length of segment member 17–18 is the same length as segment member 15–16 in FIG. 2(A) which represents the minute of seventeen past the current hour.

In FIG. 2(C), the displays represent the time of 3:45 (a.m. or p.m.). Segment member 19–20 is depicted by arc 19–20. The hour of three is indicated by segment member 19–20 having a starting position 19 which is the counter-clockwise most position of the segment member 19–20 with reference to a central point 2C on the clock face and is located at the position corresponding to the hour of three o'clock on a standard analog clock face. The length of segment member 19–20 corresponds to forty-five minutes, and is depicted by arc 19–20 ending at position 20. Thus, segment member 19–20 represents forty-five minutes past the starting position 19 which indicates the hour of three (i.e., three-fourths a complete circle representing three-quarters past the hour of three).

In FIG. 2(D), the displays represent the time of 3:00 (a.m. or p.m.). Segment member 21–22 is depicted by arc 21–22. The hour of three is indicated by segment member 21–22 having a starting position 21 which is the counter-clockwise most position of the segment member 21–22 with reference to a central point 2C on the clock face and is located at the position corresponding to the hour of three o'clock on a standard analog clock face. The length of segment member 21–22 corresponds to zero minutes, and is depicted by arc 21–22 having an ending position 22. Thus, segment member 21–22 represents zero minutes past the starting position 21 which indicates the hour of three.

In FIG. 2(E), the displays represent the time of 3:59 (a.m. or p.m.). Segment member 23–24 is depicted by arc 23–24. The hour of three is indicated by segment member 23–24 having a starting position 23 which is the counter-clockwise most position of the segment member 23–24 with reference to a central point 2C on the clock face and is located at the position corresponding to the hour of three o'clock on a standard analog clock face. The length of segment member 23–24 corresponds to fifty-nine minutes, and is depicted by arc 23–24 ending at position 24. Thus, segment member 23–24 represents fifty-nine minutes past the starting position 23 which indicates the hour of three.

Figure 5:
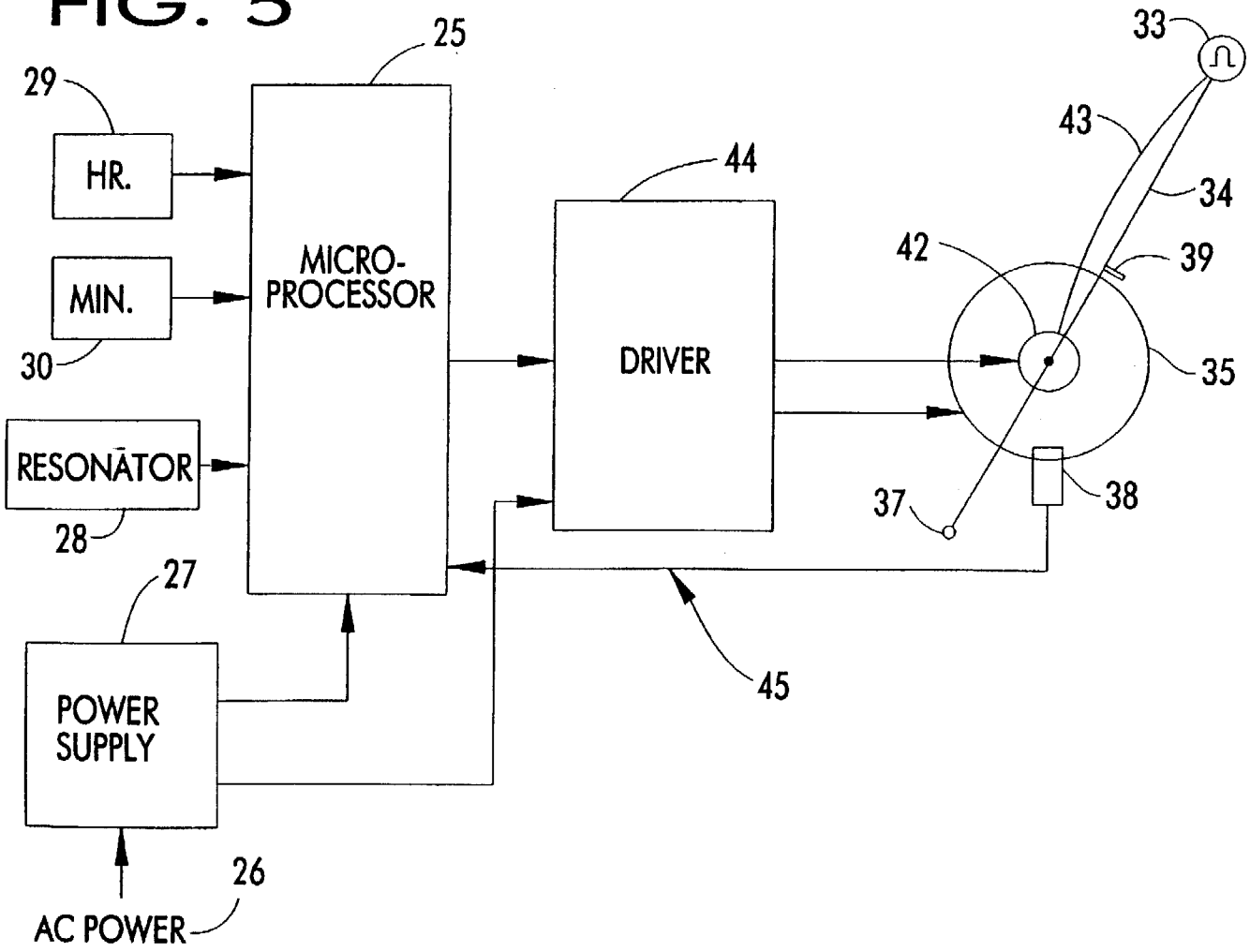
FIG. 5 is a block diagram of a circuit for controlling the clock of FIG. 4.

FIG. 5 shows a block diagram of the circuit for controlling the preferred embodiment shown in FIG. 4 and for generating the right-most illustrations of FIGS. 2(A)–(E).

In a preferred embodiment, the whirling lamp 33 is a high-intensity LED. Hewlett Packard and Sharp Electronics both make a variety of suitable high-intensity lamps by a transparent substrate process. Arm 34 supporting LED 33 comprises a thin (preferably 0.05 inch diameter) stiff steel wire. Preferably, a small d.c. electric motor 35 spins arm 34, which is mounted to its shaft, at 3660 RPM. The shaft and bearings to the case of motor 35 electrically connect steel wire arm 34, which is one conductor for lamp 33, to lamp driver circuit 44. The second electrical conductor 43 for the lamp 33 comprises thirty-six gauge enamel insulated copper wire of the type used to wind transformers and electromagnets. This second electrical conductor 43 connects lamp 33 to a brass slip ring 42 attached to the stationary part of motor 35. The second electrical conductor 43 runs along arm 34 by known means (e.g. attached with an adhesive or wrapping around arm 34) such that it is not susceptible to breakage by the rotation of arm 34. Brass slip ring 42 runs against a stationary carbon brush (not shown). Spring pressure holds the stationary carbon brush in contact with the brass slip ring 42 and is electrically connected to the lamp driver circuit 44.

Microprocessor 25 synchronizes the illuminating of lamp 33 with the position of the arm 34 using an opto-interrupter 38. Opto-interrupter 38 comprises an infrared light emitting diode facing an infrared light sensitive transistor over a small gap. Opto-interrupter 38 is attached to the stationary housing of motor 35. A thin metal flag 39 attached to the whirling wire arm passes through this gap once per revolution signalling the electronic driving means that the arm 34 is in the reference position.

The timer circuit comprising microprocessor 25, resonator 28, A.C. power 26, power supply 27, and momentary contact switches 29 and 30. These operate the same as disclosed in the first preferred embodiment.

In addition, microprocessor 25 regulates the speed of motor 35 and turns on and off lamp 33 based on the position of the lamp and time of day using a pulse width modulation technique. Speed control of motor 35 is accomplished by microprocessor 25 measuring the period of revolution of the motor 35 using the opto-interrupter signal 45 and varying the power to motor 35 by switching its driving current on and off at a high frequency and varying the portion of the cycle during which motor 35 is energized. If arm 34 is spinning too slow, microprocessor 25 increases the proportion of time during which the driving current to motor 35 is switched on. If too slow, the on-time should be decreased. This system of speed control can also compensate for variations in power supply voltage, so that part of the power supply circuit that feeds the motor need not be regulated.

The driver circuit 44 is a pair of Motorola MPF960 power MOSFET transistors. One drives motor 35, the other the LED 33. Other manufacturer's devices could be employed including International Rectifier Corporation.

The timing of the lamp is determined by incrementing a counter at a frequency that corresponds to one sixty-first of the period of the motor revolution. The frequency of the revolution of motor 35 (thus arm 34 and lamp 33) is preferably 61 Hertz. Each count then corresponds to a decision point at which the lamp would be turned on or off. Sixty-one positions are employed so the lamp can be turned on for sixty counts (at 59 minutes past the hour) of every revolution and still have the starting point, indicating the hour, be discernable.

The counter is zeroed on every pulse from opto-interrupter 38. The lighted portion of the segment member is therefore synchronized to appear stationary to the observer.

Further, a slight variation in the speed of motor 35 will not cause a cumulative error in segment member position.

Another preferred embodiment of this invention would be to replace the single color LED 33 shown in FIGS. 4 and 5 with a two color LED 33 so that the positions corresponding to hours on a standard analog clock face could be one color, while the other positions corresponding to minutes could be another color. No additional connections are need to substitute the two color LED for the single color LED 33; rather the diode chips for the two colors are wired back to back and energized individually by impressing opposite polarities on the lamp circuit. In the case of using a multi-color lamp, driver circuit 44 would be a triple half-bridge driver integrated circuit with one half-bridge circuit driving the motor and the other two half-bridge circuits forming a full bridge circuit to drive the LED to either polarity.

in another preferred embodiment, one or more additional lamps 33A can be attached along rotating arm 34 between motor 35 and LED 33 such that simple pictures of letters, figures, or other alpha-numeric characters and symbols can be displayed by microprocessor 25 selectively illuminating these additional lamps 33A.

It is also contemplated that software can create the display and implement the method of the present invention in a window or as a screen saver on the computer screen. Referring to FIG. 3, it is contemplated, for example, components 25–30 comprise a computer and the output of microprocessor 25 is directed to a CRT driver 31A which indicates the pixels and colors illuminated on CRT 32A. The display of the time of day on CRT 32A could resemble the display of the first preferred embodiment as shown in the center illustrations of FIGS. 2(A)–(E), the display of the second preferred embodiment as shown in the right-most illustrations of FIGS. 2(A)–(E), or any other teaching of this invention.

This invention uses a single segment to reflect at least two of the components of time (the three being hours, minutes, seconds). There are numerous possible variations which are within the teachings of this invention. For example, one component could be used to reflect the hour and a single segment member could be used to reflect minutes and seconds. Further, the single segment member need not extend along the perimeter of the clock face. Further, as used herein, the term clock refers broadly to time keeping devices, including for example a watch.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible preferred embodiments may be made of the invention without departing from the scope thereof, it is to be understood that all matter herein set forth or shown in the accompanying drawings is to be interpreted as illustrative and not in a limiting sense.

I claim:

1. A clock comprising:

a timer circuit for maintaining hours and minutes for a time of day;

a segment member having an adjustable length defined between a starting point indicating the hour of the day and a stopping point terminating the adjustable length and indicating the minute of the hour of the day, the segment member being adjusted to a maximum length once during each hour of the day wherein the stopping point of the segment member is generally adjacent the starting point of the segment member when the segment member is adjusted to the maximum length; and a segment member control circuit, responsive to the timer circuit and coupled to the segment member, for positioning the starting and stopping points of the segment member to adjust the length and position of the segment member to indicate the time of day maintained by the timer circuit.

2. The clock of claim 1 wherein the timer circuit and the segment member control circuit are part of a computer and comprise a microprocessor, and wherein the clock face comprises a computer display responsive to the microprocessor.

3. The clock of claim 1 wherein the segment member extends substantially along a perimeter corresponding to a standard clock face, and the length of the segment member from the starting point to the stopping point represents the number of minutes elapsed during the hour of the time of day maintained by the timer circuit.

4. The clock of claim 3 further comprising a clock face having a reference point, the clock face having a top position which represents noon and midnight for a twelve hour display mode, or which represents midnight for a twenty-four hour display mode; and wherein the position of the starting point of the segment member is a counter-clockwise-most point of the segment member relative to the reference point on the clock face, the position of the starting point relative to the top location reflects the hour of the time of day maintained by the timer circuit, and the position of the stopping point relative to the starting point reflects the minute of the hour of the time of day maintained by the timer circuit.

5. The clock of claim 4 wherein the segment member control circuit defines the position of the starting point to indicate the hour of the time of day maintained by the timer circuit, the position of the starting point being a clockwise angular distance measured at the reference point on the clock face from the top position to the starting point; and wherein the segment member control circuit defines the position of the stopping point to indicate the minute of the hour of the time of day maintained by the timer circuit, the position of the stopping point being a clockwise angular distance measured at the reference point on the clock face from the starting point to the stopping point.

6. The clock of claim 1 wherein the segment member is defined by lights located around the perimeter of a standard clock face.

7. The clock of claim 5 wherein the clock face comprises an array of lights on the clock face spaced about the reference point on the clock face; and wherein the segment member control circuit comprises a light control circuit for selectively illuminating one or more lights of the array defining the position of the starting point, defining the position of the stopping point, and defining the position of the segment member relative to the reference point.

8. The clock of claim 4 wherein the light at the starting point is one color, and the remaining lights of the segment member are another color.

9. The clock of claim 4 wherein the lights at positions on the clock face relative to the reference point which correspond to hours are one color, and the remaining lights are another color.

10. The clock of claim 7 wherein the light control circuit controls a crossbar array with each light on the clock face connected to a different crosspoint position and wherein the light control circuit selectively energizes the crosspoints to illuminate at least one light, with each light defining the segment member either continuously illuminated or switched on and off at a high rate to appear continuously illuminated.

11. The clock of claim 7 wherein the light control circuit comprises a microprocessor and a light driver means for selectively illuminating the lights.

12. The clock of claim 1 wherein the timer circuit comprises a microprocessor, a resonator and a timing circuit for maintaining the hours and minutes of the time of day.

13. The clock of claim 1 further comprising a power supply circuit including a battery for providing power to the timer circuit and the light control circuit.

14. A clock comprising:

a timer circuit for maintaining hours and minutes for a time of day;

a segment member positioned on a standard clock face positioned about a reference point and having an adjustable length defined between a starting point indicating the hour of the day and a stopping point indicating the minute of the hour of the time of day;

a segment member control circuit, responsive to the timer circuit and coupled to the segment member, adjusting the starting and stopping points to reflect the time of day maintained by the timer circuit;

a motor, having a stationary assembly and a rotatable assembly in magnetic coupling relation to the stationary assembly, mounted with the rotatable assembly at the reference point, the rotatable assembly connected to the light and rotating the light about the reference point; and a position sensor providing a control signal indicating a position of the rotatable assembly;

wherein the segment member control circuit comprises a light control circuit, responsive to the position sensor and timer circuit, for selectively illuminating the rotating light defining the position of the starting point, defining the position of the stopping point, and defining the position of the segment member relative to the reference point.

15. The clock of claim 14 wherein the light at the starting point is one color, and the light representing the rest of the segment member is another color.

16. The clock of claim 14 wherein a color of the segment member at positions relative to the reference point which correspond to hours are one color, and a color of the segment member at remaining positions is another color.

17. The clock of claim 14 wherein the rotating light comprises a two color LED wherein one color of the light is illuminated when voltage is applied, and the other color of the light is illuminated when the opposite polarity of voltage is applied.

18. The clock of claim 14 comprising a metal flag connected to the rotating assembly; and an opto-interrupter on the stationary assembly of the motor and associated with the metal flag for providing a control signal once per revolution of the rotating assembly when the metal flag passes the opto-interrupter.

19. The clock of claim 14 further comprising an arm supporting the light rotating about the reference point and having one or more additional lights and wherein the light control circuit selectively illuminates the additional lights whereby a display of letters, figures or other symbols is generated.

20. The method of generating a display to reflect hours and minutes for a time of day comprising the steps of illuminating a starting point to reflect the hours and illuminating a stopping point relative to the starting point to reflect the minutes, the starting and stopping points defining a segment member therebetween having an adjustable length, the segment member being adjusted to a maximum length once during each hour of the day wherein the stopping point of the segment member is generally adjacent the starting point of the segment member when the segment member is adjusted to the maximum length.

21. The method of claim 20 wherein the length of the segment indicates the number of minutes elapsed during the hour of the day.

22. A clock comprising:

a standard clock face;

a timer circuit for maintaining hours and minutes for a time of day on the clock face;

a segment member having an adjustable arcuate length defined between a starting point indicating the hour of the day and a stopping point terminating the arcuate length of the segment member, the arcuate length of the segment member indicating the minute of the hour of the day, the segment member being adjusted to a maximum length once during each hour of the day wherein the stopping point of the segment member is generally adjacent the starting point of the segment member when the segment member is adjusted to the maximum length; and a segment member control circuit, responsive to the timer circuit and coupled to the segment member, adjusting the starting and stopping points to reflect the time of day maintained by the timer circuit.

23. A clock comprising:

a timer circuit for maintaining hours and minutes for a time of day;

a standard clock face having sixty time increments, comprised of twelve hour increments and four minute increments between each of the hour increments;

a segment member having an adjustable length for displaying time, each of the sixty time increments defining a portion of the segment member at least once during each hour of the time of day; and a segment member control circuit, responsive to the timer circuit and coupled to the segment member, adjusting the length and position of the segment member to reflect the time of day maintained by the timer circuit.

* * * * *